US009631325B2

(12) United States Patent
Lichtberger

(10) Patent No.: US 9,631,325 B2
(45) Date of Patent: Apr. 25, 2017

(54) APPARATUS FOR IMPROVING THE TRACK POSITION BY RESIDUAL ERROR COMPENSATION

(71) Applicant: System 7—Railsupport GmbH, Vienna (AT)

(72) Inventor: Bernhard Lichtberger, Pregarten (AT)

(73) Assignee: System 7—Railsupport GmbH, Vienna (AT)

( * ) Notice: Subject to any disclaimer, the term of this patent is extended or adjusted under 35 U.S.C. 154(b) by 159 days.

(21) Appl. No.: 14/741,898

(22) Filed: Jun. 17, 2015

(65) Prior Publication Data

US 2015/0368865 A1 Dec. 24, 2015

(30) Foreign Application Priority Data

Jun. 18, 2014 (EP) ..... 14172959

(51) Int. Cl.
*E01B 27/00* (2006.01)
*E01B 27/17* (2006.01)

(52) U.S. Cl.
CPC ..... *E01B 27/17* (2013.01)

(58) Field of Classification Search
CPC ..... E01B 27/17
USPC ..... 33/338, 287
See application file for complete search history.

(56) References Cited

U.S. PATENT DOCUMENTS 4,155,176 A * 5/1979 Goel ..... B61K 9/08 33/287
5,481,982 A * 1/1996 Theurer ..... E01B 27/17 33/287
6,220,170 B1 * 4/2001 Theurer ..... E01B 33/00 33/287
6,260,485 B1 * 7/2001 Theurer ..... E01B 29/04 33/287

(Continued)

FOREIGN PATENT DOCUMENTS

AT 289177 B 4/1971
DE 10 337 976 A1 4/2004

OTHER PUBLICATIONS

Espacenet English language abstract of DE 10 337 976 A1, published Apr. 1, 2004.

*Primary Examiner* — Yaritza Guadalupe-McCall
(74) *Attorney, Agent, or Firm* — Tiajoloff & Kelly LLP

(57) ABSTRACT

A track adjustment system for operating a permanent-way machine (17) which is displaceable on a track system (1) comprises computer-controlled lifting and lining devices adjusting the track position, a control measuring system measuring the track position in the region of the lifting and lining devices (14), an acceptance measuring system measuring the corrected track position, and a tamping unit (24) tamping a ballasted track of the track system (1). For the purpose of achieving an improved track lining result, the amount of the elastic springback ($\Delta c_w$) of the track panel, which is the result of a lining force (F) acting on the track, is calculated and said elastic springback ($\Delta c_w$) is considered (Continued)

in the target value lining specification in such a way that the track is displaced with the lifting and lining devices by the amount of the elastic springback ($\Delta c_w$) beyond the target position (0).

14 Claims, 8 Drawing Sheets

(56) References Cited

U.S. PATENT DOCUMENTS

| | | | | |
|---|---|---|---|---|
| 2010/0088914 | A1* | 4/2010 | Cerwin | E01B 35/02<br>33/645 |
| 2010/0154233 | A1* | 6/2010 | Theurer | B61K 9/08<br>33/287 |
| 2015/0368865 | A1* | 12/2015 | Lichtberger | E01B 27/17<br>104/7.2 |

* cited by examiner

APPARATUS FOR IMPROVING THE TRACK POSITION BY RESIDUAL ERROR COMPENSATION

The invention relates to a track adjustment system for operation of a permanent-way machine which is displaceable on a track system, comprising computer-controlled lifting and lining devices for adjusting the track position, a control measuring system for measuring the track position in the region of the lifting and lining devices, an acceptance measuring system for measuring the corrected track position, and a tamping unit for tamping a ballasted track of the track system.

Most tracks for railways are arranged as ballasted tracks. The sleepers lie in the ballast. The ballast is provided for dissipating the wheel forces into the subgrade, the absorption of transverse forces acting on the rail and the sleepers, and the drainage of the surface water. Irregular subsidence in the ballast and displacements in the lateral positional geometry of the track are caused by the acting wheel forces of the trains that travel over said ballast. The subsidence in the ballast bed causes errors in the longitudinal level, the superelevation (in the curve), the twisting, the track gauge and the track lining position. If specific limit of comfort values of these geometric quantities are exceeded, maintenance work is planned and performed. If previously determined danger values are exceeded, the speed is reduced depending on the magnitude of the faults, or the track is blocked and the repair of the so-called individual faults is carried out immediately.

The repair and correction of these geometric track faults is mostly currently carried out by means of track construction machines. In order to ensure that the track can be released for operation again after such track geometry repair work, the permanent-way railway machine is mostly equipped with so-called acceptance measuring systems and acceptance recording systems. Acceptance tolerances are determined for the quality of the track position after the improvement by the permanent-way machines or other methods. They represent the minimum requirements placed on the quality of the produced geometric improvements. They are proven by acceptance measuring systems and acceptance recording systems.

The quantities to be mentioned, corrected and recorded are the twisting of the track, longitudinal level of the track, direction or lateral position of the track, the track gauge, and the transverse inclination or superelevation of the track. A permanent-way railway machine such as a track tamping machine rebuilds the track geometry which was adversely affected by loading by trains. For this purpose, the track is lifted and lined to the target position by means of lifting and lining devices controlled in an electrohydraulic manner. The necessary forces depend on the size of the rails, the sleepers, the frictional forces between the sleepers and the ballast bed, the effective length of the track section subjected to the force, and other factors. The introduction of force occurs by way of hydraulic cylinders, which is why the acting forces could be measured via pressure measurements by means of pressure sensors. Directly measuring force sensors could obviously also be used.

One problem in the correction of the track position is that the track system comprises elastic components. The acting force for correcting the track position leads to the deflection (tilting) of the rail in the rail fastening, which depends on the lining force and can lie in the magnitude of 2 to 6 mm. Furthermore, the rail can slip laterally with the rail foot in the rail fastening as a result of the production tolerances, wherein this movement lies in the magnitude of 1 mm in the case of conventional forces. It is further known that a laterally displaced track panel (as a result of the rail bending torques) will elastically spring back between 1 to 2 mm after the lining. If the track is lifted and the ballast is tamped beneath the sleepers with the tamping tools in order to fix the track position, subsidence will already occur as a result of the loading of the wheels of the track construction machine itself. The magnitude of this subsidence depends on the magnitude of the lifting, the underlying ballast bed thickness (the ballast bed is thicker under the raised rail in the superelevated track), the state of the ballast (whether or not it is contaminated), the ballast itself (meshing capability of the grains, form, material, degree of soiling), the weather (wet bedding leads to higher subsidence) and the axle load. Since more ballast is situated under the raised rail in the track curve, this side subsides to a slightly higher extent than the so-called reference track system. This leads to noticeable superelevation and twisting faults. Twisting faults are especially relevant because they represent the critical quantity for derailments. Even in the case of a theoretically absolutely correct correction of faults by the track construction machine, track faults still remain as a result of the springing back of the rail and the track panel as well as the subsidence. The fewer faults remain after the track processing, the lower the force interaction with the wheels of the trains that roll over said track and the higher the operational lifespan of the achieved track geometry position. It is therefore desirable to move the track geometry as close as possible to the target position because considerable costs and efforts can thus be avoided.

There are measuring systems for the lining, the lifting and the transverse inclination for controlling the process. Since these measuring systems are usually equipped with steel cords, systematic errors of the measuring systems occur. These systematic errors are calculated and compensated by means of algorithms by the control computer. The target geometries of the railway tracks are available as track plans and can be used after the input in the control computer for calculating the systematic errors by knowing the behaviour of the measuring systems.

If as is common practice in some countries no such target track geometries are known, a track can be travelled with the existing measurement systems of the permanent-way machine and the measuring data can be stored. Improved smoothed track geometry progressions can be optimised from the said measured data. Lifting and lining correction values can be determined by comparison of the said smooth track geometry curves with the measured actual values, which correction values can be used after calculation for controlling and guiding the machine. The acceptance of such corrective values from other measuring and evaluation measuring systems is possible. It is a further possibility to electronically accept target track geometry data.

An independent acceptance measuring system, which is usually connected to the machine via a trailer, is provided for documenting the achieved quality of the work. The recorded measurement quantities substantially concern the same measurement quantities as those of the control system of the track construction machine, but based on other cord lengths. These data are printed out, stored and/or displayed on a screen.

The invention is thus based on the object of further developing a track adjustment system of the kind mentioned above in such a way that residual errors of the track position can be reduced after the lining and lifting.

This object is achieved by the invention in such a way that the amount of the elastic springback of the track panel, which is the result of a lining force acting on the track, is calculated and said elastic springback is considered in the target value lining specification in such a way that the track is displaced with the lifting and lining devices by the amount of the elastic springback beyond the target position. The springback of the rail can also occur by measurement, wherein the amount of the springback is directly detected by the track lining sensor after the removal of the lining forces.

It is the intention of the invention to keep the residual errors in the track position after the lining as low as possible, which errors are caused by the springback of the rails and the track panel, and should ideally tend towards zero. This can occur on the one hand by force measurement on the displacing cylinders (e.g. by a pressure sensor) and the calculation or measurement of the expected elastic springback paths. The track is thus aligned during the lining beyond the amount it subsequently springs back, and it springs back after the lining to the target position.

For the purpose of further minimising the lining error, an average lining error can be calculated from the difference between the target position and the acceptance measurement by the acceptance measurement system, by which the track is additionally displaced by the lifting and lining devices within the terms of approaching the target position. The actual remaining error and the average value therefrom are calculated from the cord measurements of a cord measurement sensor of the acceptance measuring system via a conversion by means of a reconstruction method (see DE10337976 A for example) and by considering the transfer function of the cord system. Both values are added to the lining value, which is predetermined by a control and master computer. As a result, the track is slightly overpressed during lining by the track construction machine, and the track thus ideally springs back to the desired target position after termination of the lining.

It is further recommended that the resulting subsidence of the superelevation of the rail track is calculated and is considered in the target value of the superelevation default value in such a way that the track is lifted with the lifting and lining devices by the amount of the calculated subsidence beyond the target position. As a result, the superelevation error after the lifting of the track can be compensated by the subsidence of the track occurring during the lining and the tamping. This occurs especially by the calculation of the expected subsidence. Unequal subsidence, which occurs directly after the lifting and tamping process and is revealed in a superelevation error, can be measured by an inclinometer by direct measurement of said superelevation error after the deactivation of the lifting forces.

Furthermore, a mean superelevation error can be calculated from the difference between the target position and the acceptance measurement by the acceptance measuring system, by which the track is additionally displaced by the lifting and lining devices within the terms of an approach to the target position. Remaining subsidence faults can be adjusted by said mean value. Both values, i.e. the superelevation error and the mean superelevation error, are added to the superelevation default which is predetermined by the control and master computer. In reality, the superelevated rail track is lifted slightly higher and after the expected subsidence the track ideally assumes the desired target superelevation.

The lining force is preferably measured by means of force sensors and/or pressure sensors assigned to the lifting and lining devices. The elastic springback of the track is calculated from the respective measurement values. The subsidence of the superelevation of the rail track of a track system is calculated for example from the height level of the superelevated rail track. The respective mathematical correlations are explained in the description of the drawings.

The control measuring system and the acceptance measuring system are especially preferably assigned a common output device, especially a monitor or data logger, with which the results of the measurement are displayed. All relevant data can thus be displayed directly on an output device and can be monitored by a controller. Furthermore, it can simultaneously be displayed whether the required tolerances are maintained, for which purpose the corrective values can be displayed in the common output device. It is advantageous in this respect if a common computing device is assigned to the control measuring system and the acceptance measuring system, in which all data are combined and processed. All data of the X/Y coordinates can be displayed in a similarly aligned manner by combining the two computers and output devices according to the prior art, especially the screens, for the control and master computer and for the acceptance computer data logger. As a result, both the target requirements of the track geometry and the aligned track geometry can be displayed on a divided screen on an acceptance record. This configuration not only improves ergonomics and readability, but the corrective values and their effect on the quality of the produced track geometry can be traced and checked in the records on the screen.

If positional data determined by means of a GPS device are assigned to the measured values of the control measuring system and the acceptance measuring system, the individual measured data can be directly assigned unique positional data, thus ensuring clean documentation and that individual positions can be found precisely for follow-up work or subsequent inspection. Furthermore, the measured values of the control measuring system, the acceptance measuring system and/or the corrective values can be transmitted via a radio transmission link to a computer system. As a result, the data can be transmitted to a data-processing centre, thus offering the possibility of central monitoring of the progress of the work. Since the corrective values in connection with this invention and the other resulting data are relevant to safety, the most direct delay-free transmission of these data to the person responsible for the railways is important. That is why the system is equipped with a wireless transmission device such as GSM or the like, so that data can be transmitted by polling. Data concerning the type of the rail, the rail fastening and the sleepers are also transmitted via said wireless connection from the railway database, so that the amount of the elastic deflection of the rail by the lining force can be compensated correctly.

It is further recommended if the track system is monitored by at least one image recording device and if the data of the at least one image recording device are preferably transmitted via a radio link, especially wireless LAN, to a computer device, where measured values, corrective values and optionally positional data are assigned to the image data. As a result, peculiarities in the track position, which prevent the achievement of the desired track geometry, can be documented. An informative icon will be displayed on the screen image of the acceptance record at the respective location. If it is activated, the stored image is displayed on the screen.

The subject matter of the invention is schematically shown in the drawings for example, wherein.

Figures 2, 2A, 2B, 2C:
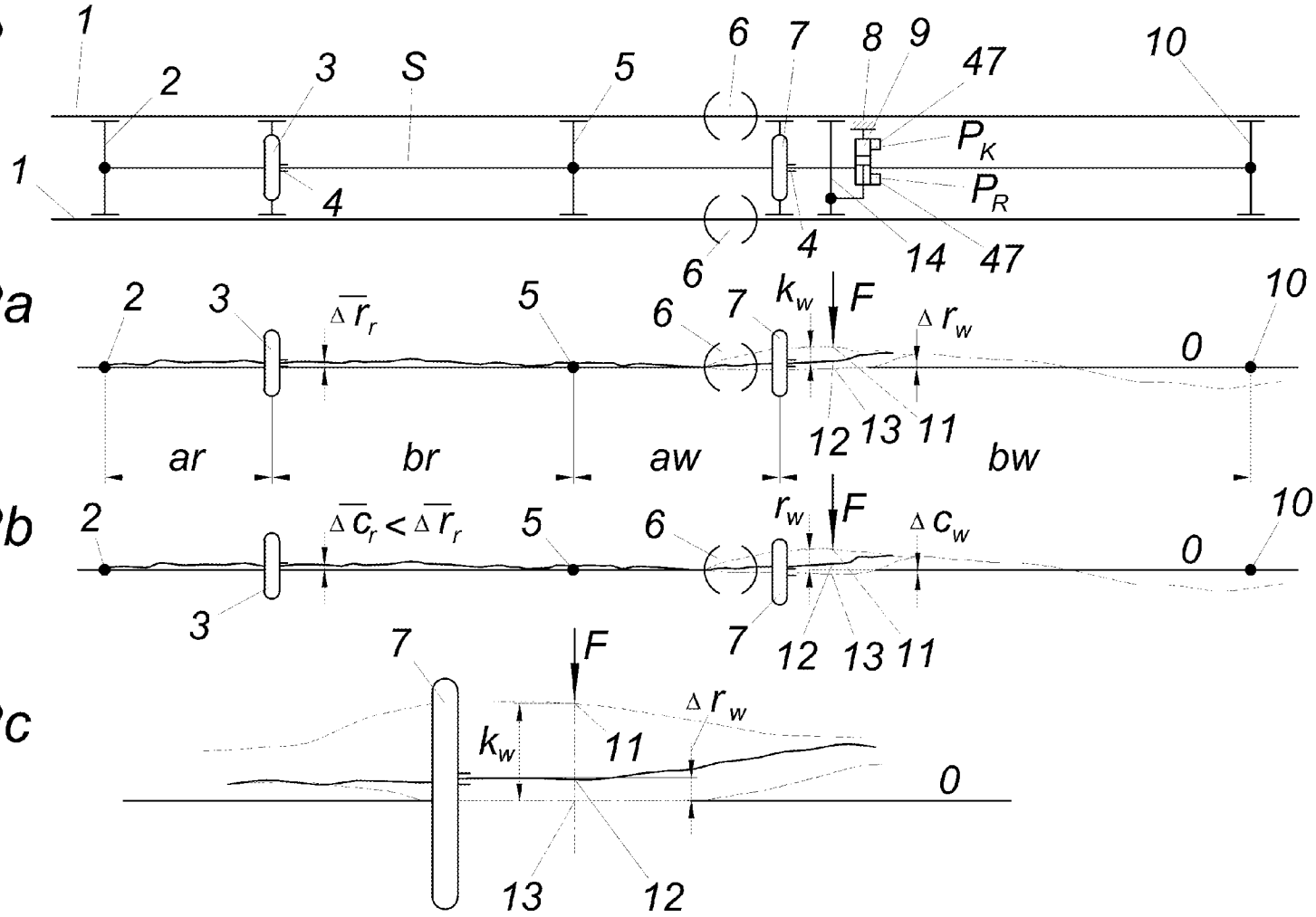
FIG. 2 shows a top view of the control measuring system and the acceptance measuring system.
Figure 3:
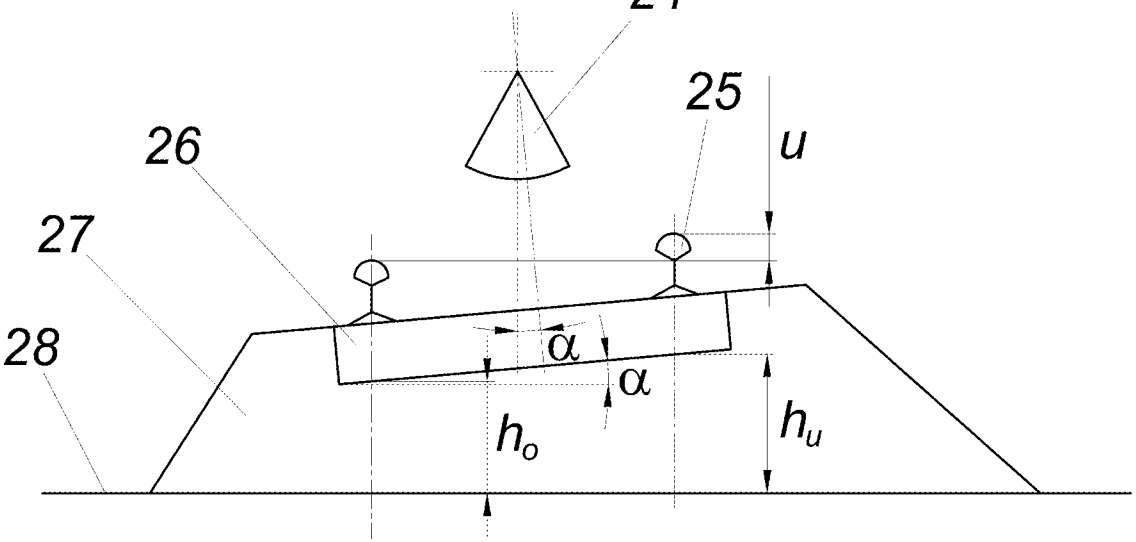
Figures 4, 4A, 4B:
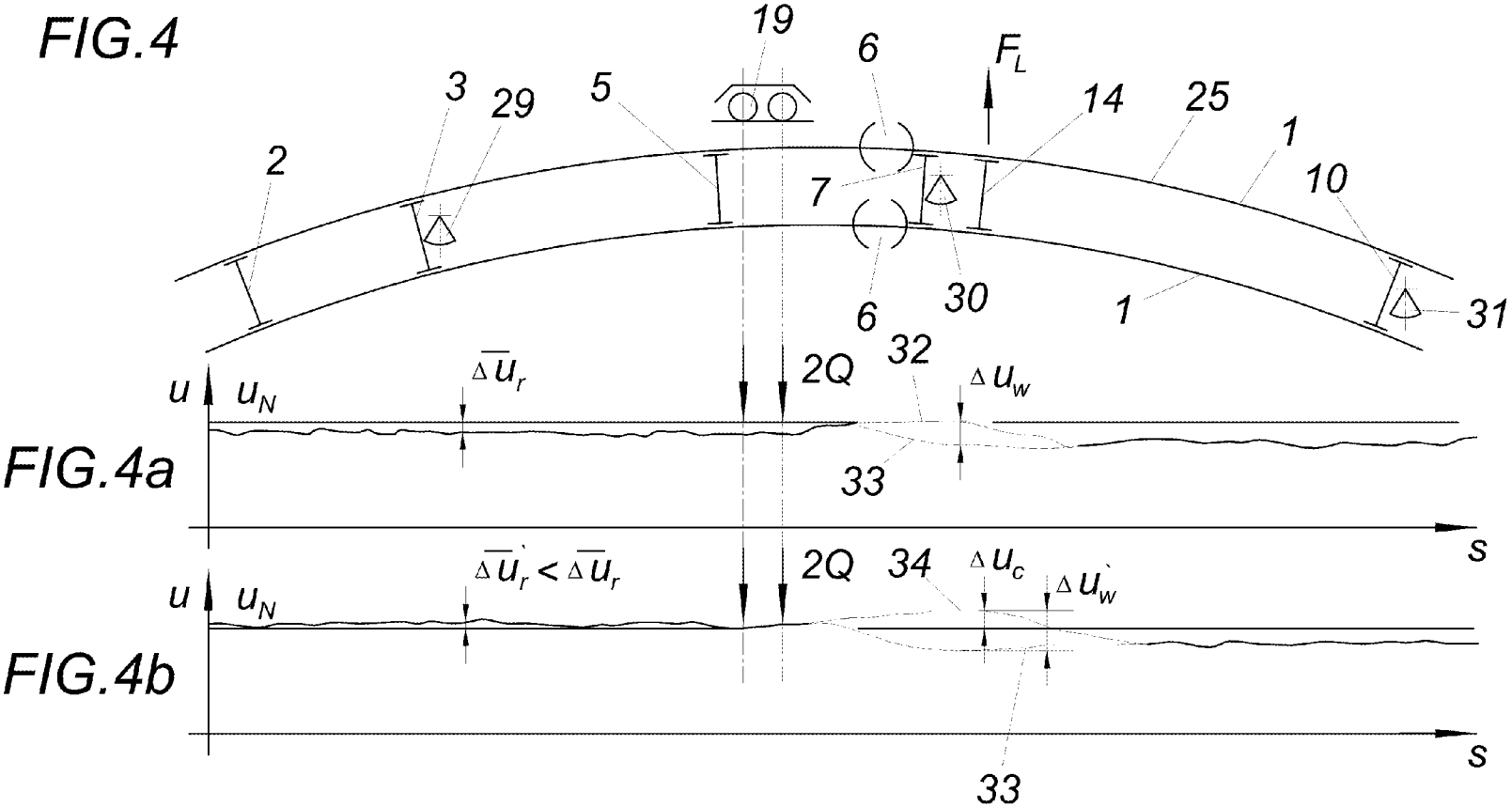
Figure 5:
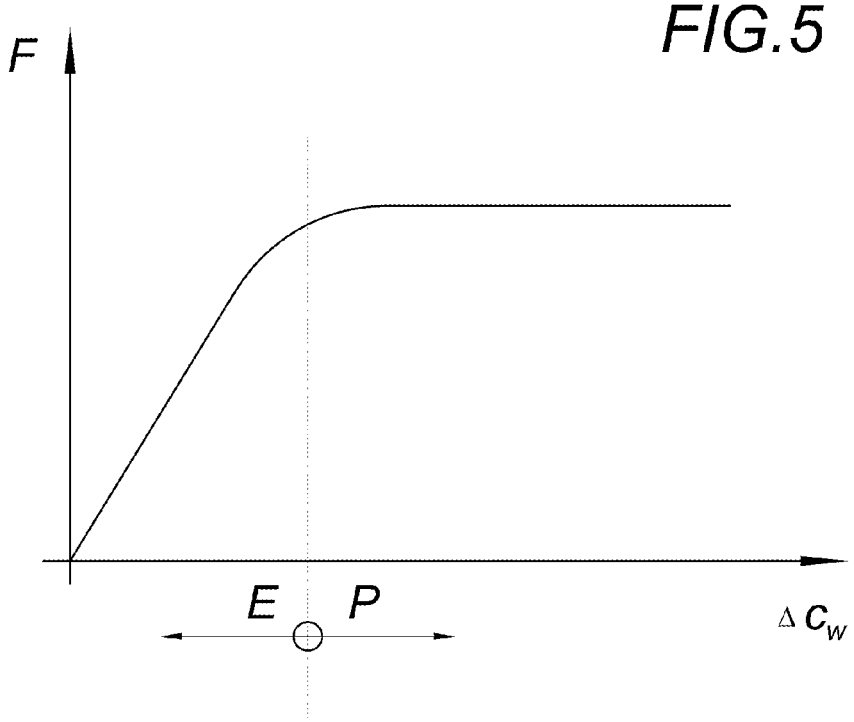
Figure 6:
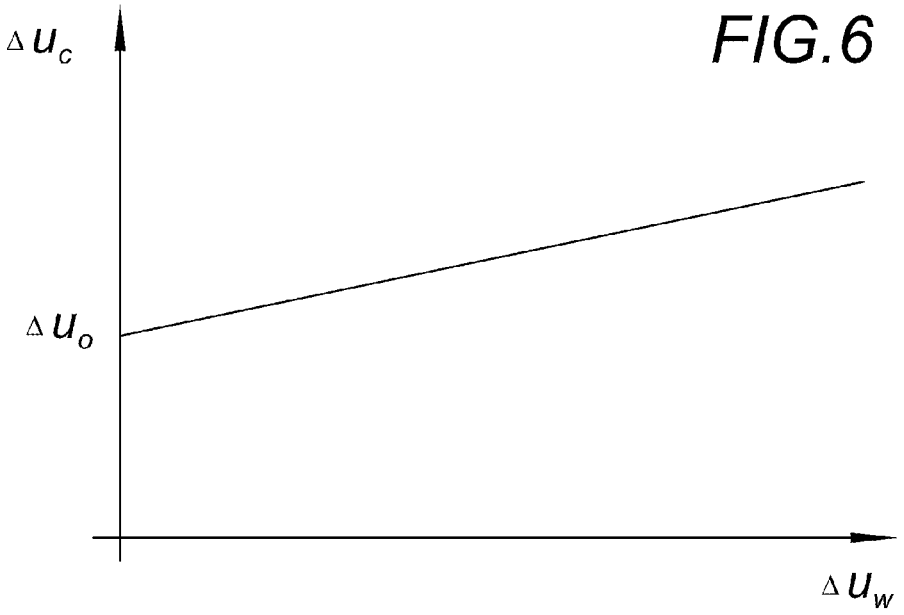
Figure 7:
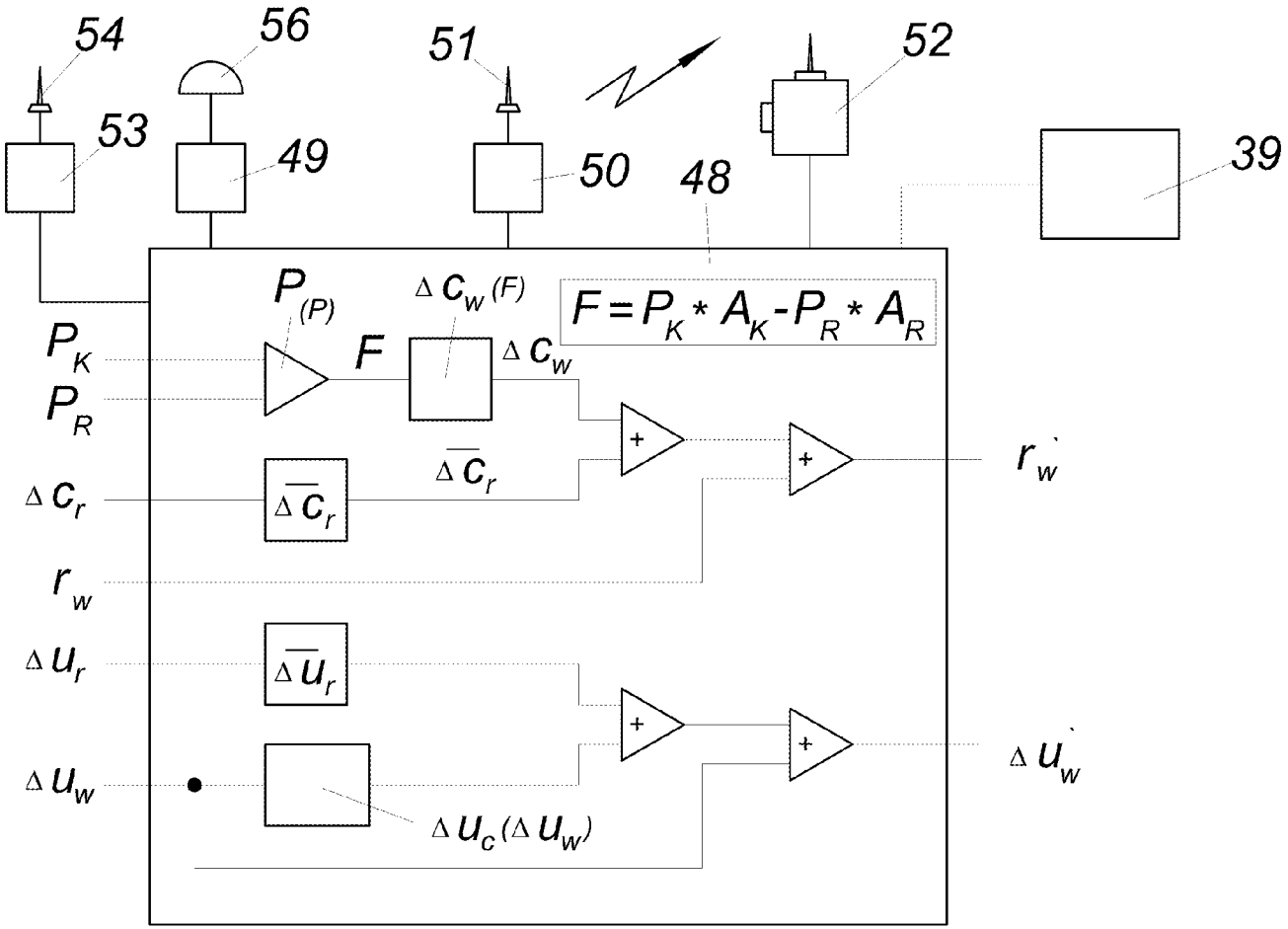
Figure 8:
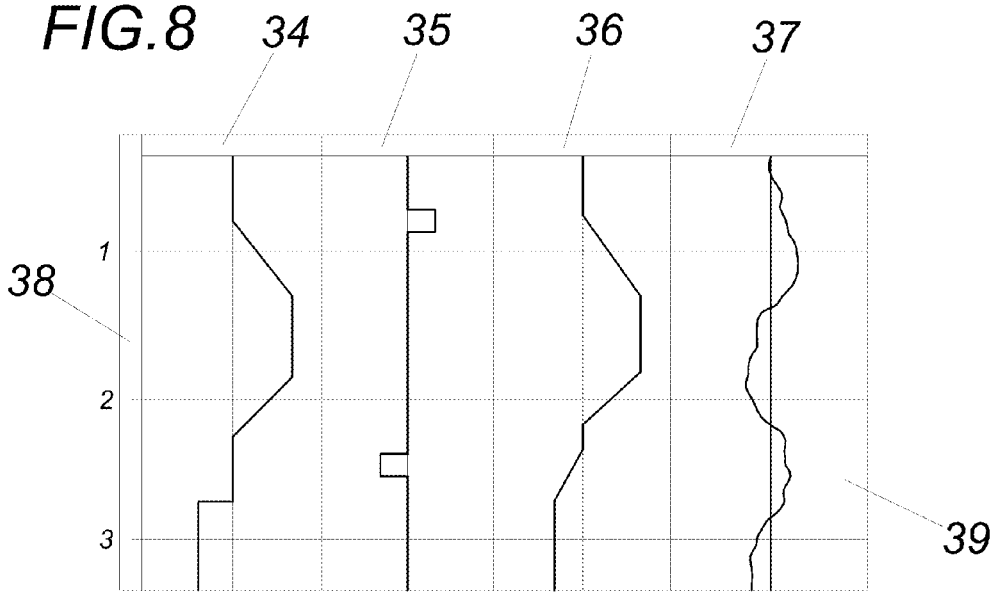
Figure 9:
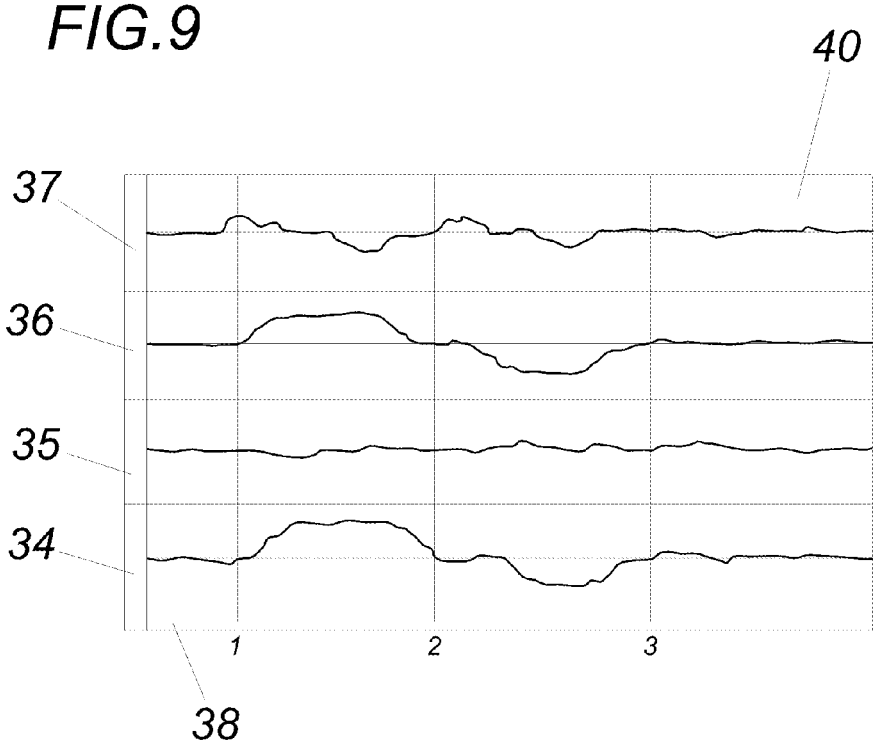

FIGS. 2*a* to 2*c* show simplified views of the track position in a top view;

FIG. 3 shows a superelevated track in a cross-sectional view through the ballast bed;

FIGS. 4 to 4*b* show a simplified view of the superelevation;

FIG. 5 shows a diagram concerning the connection between the lining force and the springback effect;

FIG. 6 shows a diagram concerning the correlation between the lifting value and the superelevation;

FIG. 7 shows a functional diagram of a computer control system of the track adjustment system;

FIGS. 8 and 9 shows screen displays according to the prior art, and

Figure 10:
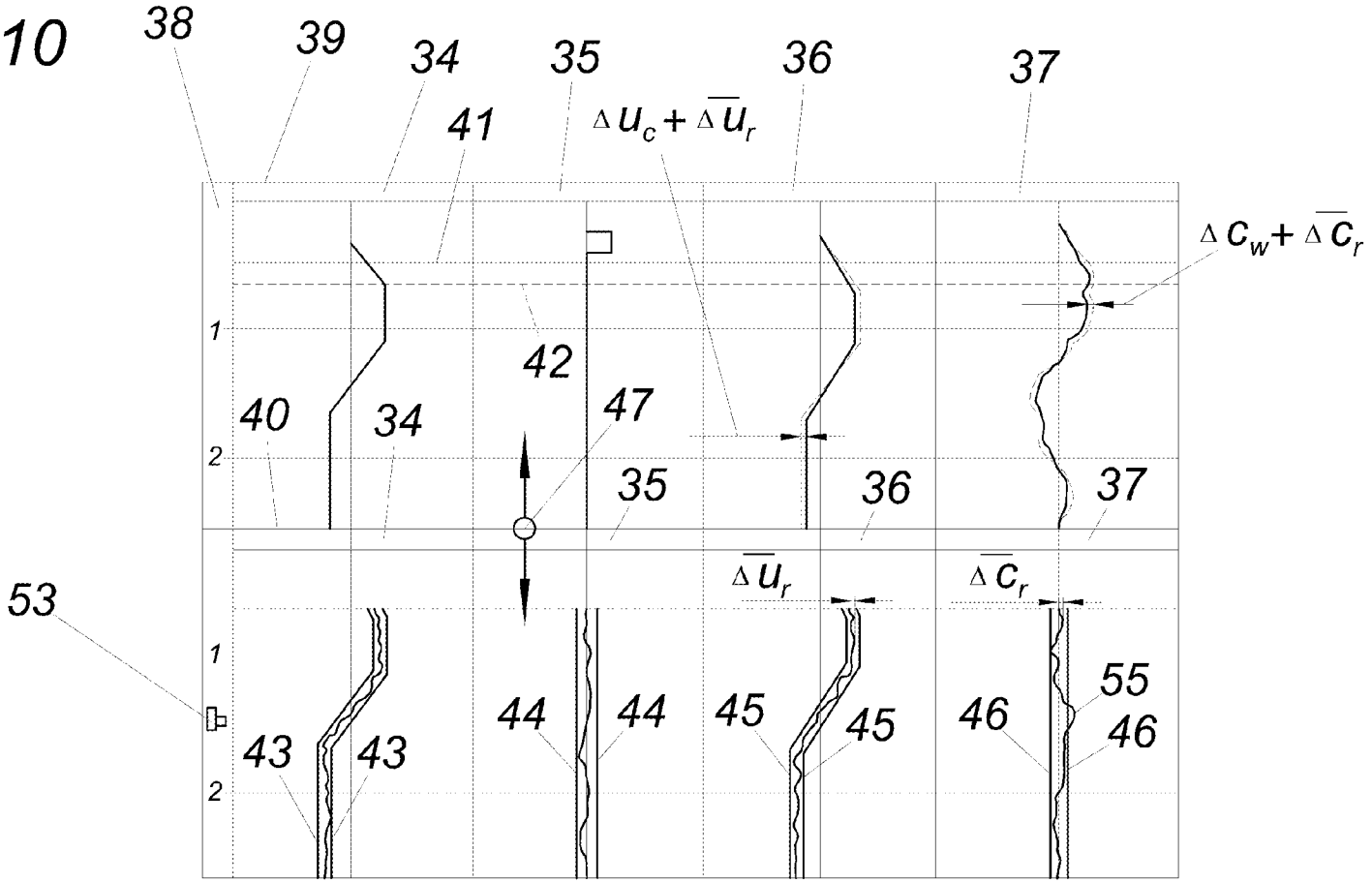

FIG. 10 shows a screen display in accordance with the invention.

Figure 1:
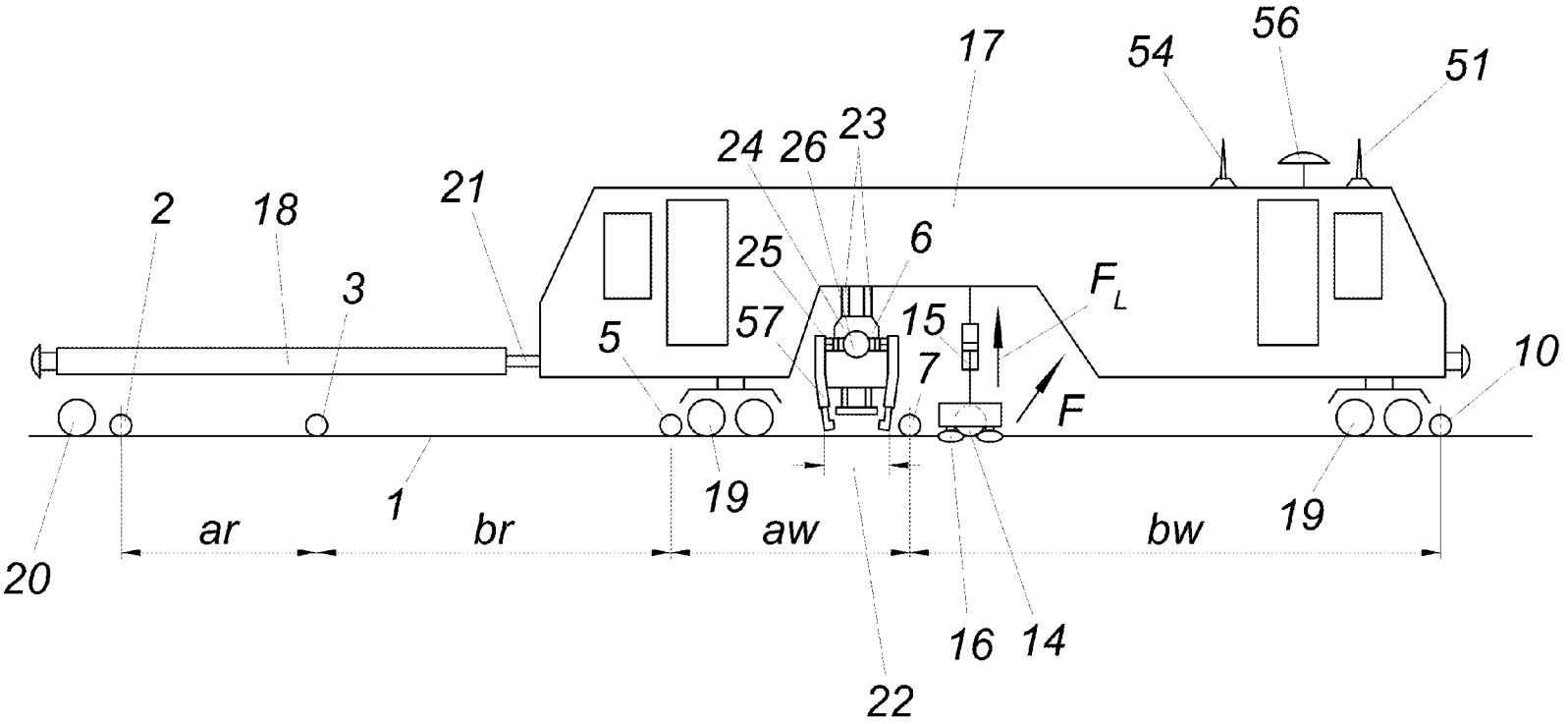
FIG. 1 shows a track construction machine in a side view, having a track adjustment system in accordance with the invention.

FIG. 1 shows a permanent-way machine 17, which comprises a tamping unit 24 consisting of a vibration drive 26, a lateral feed cylinder 25 which can be reciprocated on guide columns 23, and tamping tools 23. During the tamping, the tamping tools 57 enter the ballast on either side of the sleepers and compact said ballast, so that the lifted and aligned track panel maintains its position after the tamping and the advancement of the machine. The track panel is lifted to the target position via the lifting cylinders 15 and the lifting rollers 16, which act on the rail head. The track panel is brought to the lined position via the lifting and lining devices for adjusting the track position, i.e. the track lining roller 14.

A control measuring system for measuring the track position comprises a cord measuring system, i.e. a tensioned steel cord consisting of the sections $a_w$ and $b_w$ as well as a track lining measuring carriage 7 and an encoder via which the deflection of the steel cord is measured. The acceptance measuring system comprises a trailing measuring cord consisting of the sections $a_r$ and $b_r$, by means of which the achieved track position is measured and recorded. The acceptance measuring system is situated beneath a trailer 18, which is connected via a drawbar 21 to the main machine and which runs on the other side by a running gear 20 on the track. The main machine per se rests on the two bogeys 19. The working cord is tensioned between a front tensioning carriage 10 and a rear tensioning carriage 5. The measuring cord is tensioned between the rear tensioning carriage 5 and the rear acceptance tensioning carriage 2. The entire vehicle is movable on the track system 1. FIG. 1 also shows the arrangement of a GPS antenna 48, a wireless LAN antenna 51 and a radio antenna 54 for the wireless transmission of the data.

FIG. 2 schematically shows in the upper image section the two rails of the track system 1. The illustration further shows the front tensioning carriage 10, the track lining measuring carriage 7 with the lining sensor, the rear tensioning carriage 5, the rear acceptance track lining measuring carriage 3 and the rear acceptance tensioning carriage 2. The deflection is respectively detected by means of potentiometers via drivers 4 which are suspended in the cords. The illustration further shows the lining unit 14, which is to push the track to the target position by means of the lining cylinder 9. The pressures in the lining cylinder 9 and thus the active lining force F are detected by the pressure sensor 47 ($p_R$ pressure acting on the cylinder ring surface and $p_K$ pressure acting on the cylinder piston surface). The position of the tamping units 6 is also indicated.

The diagram according to FIG. 2*a*, which is shown underneath, is further shown in a simplified view. The illustration now only relates to the track axis. The dashed line shows the position of the faulty track. The deflection $k_w$ can be seen on the lining sensor 7 before the lining. If the track is pressed to the zero position by means of the lining cylinder (amplitude on the lining sensor=0–dashed line) and the lining cylinder is switched back to idle running, the track will spring back by the value $\Delta r_w$. In reality, the fault was only corrected to the measure $r_w$. If the machine progresses to the next tamping process, this fault remains in the track. The residual error $\Delta r_r$ then occurs on the acceptance record.

The diagram according to FIG. 2*b* shows the effect intended by the invention. The dashed line shows the lining error before the tamping. The target value is predetermined in such a way however that the track is overpressed by the measure $\Delta c_w$. After the lining process, the track springs back by this measure and comes to lie in the intended zero position. The tendency of any still remaining minor lining errors is detected by the acceptance measurement 3 by the mean value $\Delta c_r$. In the detail X according to FIG. 2*c*, the conditions of FIG. 2*a* are shown on an enlarged scale. The straight line 0 stands for the position of the ideal track.

FIG. 3 shows a superelevated track in the cross-sectional view in a curved arc. The ballast bed 27, a sleeper 26 and the subgrade 28 are shown. The ballast bed thickness $h_0$ beneath the reference rail (which remains at zero as regards height) and the ballast bed thickness $h_u$ beneath the super elevated rail are shown. u stands for the superelevation of the track and $\alpha$ for the superelevation angle. Reference numeral 25 is the rail superelevated by u. The superelevation is measured by means of a pendulum sensor 24.

FIG. 4 schematically shows in the upper image section two rails of the track system 1 again. The actual superelevation is detected at the front tensioning carriage 10 via the preliminary measuring pendulum 31. The working pendulum 30 is mounted at the working location close to the track lining measuring carriage 7. The acceptance pendulum 29 is located on the acceptance measuring carriage 3. The position of the rear bogey 19, which already exerts a force on the tamped track which leads to subsidence, is also shown. The track is lifted via two hydraulic cylinders (one on the left and one on the right) by means of the lifting and lining device 14. In this process, the superelevated track 25 is lifted by the superelevation u over the reference track of the inner side of the arc.

The further simplified diagram according to FIG. 4*a* represents the progression of the superelevation u over the path of the track. $u_N$ designates the target superelevation. The dashed line shows the progression of 33 of the superelevated rail with respect to the rail on the inside of the arc prior to lifting. In order to bring the rail to the target superelevation $u_N$, the rail must be lifted by $\Delta u_w$ (dashed line 32). The track subsides by $\Delta u_r$ under the axle load of the following bogey (2Q axle loads). This fault is detected by the acceptance measuring record.

The effect of the invention is illustrated in the diagram according to FIG. 4*b*. The non-processed track (dashed line 33) is now additionally lifted by the expected subsidence amount $\Delta u_c$. After the subsidence process, caused by the bogey 19, only a minor average residual error $\Delta u_r$ occurs after the subsidence process.

The diagram according to FIG. 5 represents the correlation between the lining force F and the springback of the track panel $\Delta c_w$. E represents the elastic springback progression of the curve, whereas P represents the plastic progression (remaining track displacement). The amount of the elastic springback $\Delta c_w$ can be calculated via this mathematical correlation.

FIG. 6 represents the correlation between the subsidence of the superelevation $\Delta u_c$, depending on the lifting value $\Delta u_w$ of the superelevated track in form of a diagram. The diagram shows that subsidence $\Delta u_0$ occurs even under lifting=0 as a result of the loosening of the ballast bed during tamping.

The control diagram of a track adjustment system in accordance with the invention is shown in FIG. 7. The computer unit 48 combines the acceptance and control computer and is expanded by the functionality shown in the illustration. The screen display of the geometric guidance and the acceptance recording are combined on the monitor 39. Conversion to the lining force is carried out via the hydraulic pressures pK and pR. The springback path is calculated by the correlation between the force and the springback (see FIG. 5). Via the residual lining error $\Delta c_r$, which is determined by the acceptance measurement, the mean value of $\Delta c_r$ is formed over a baseline (of approximately 5-10 m) and added to the springback path $\Delta c_w$ . This corrective value is added to the predetermined lining value $r_w$ and is output as the new target lining value $r_w'$ to the control unit by the computer.

The subsidence $\Delta u_c$, which is dependent on the lifting value $\Delta u_w$ of the superelevated rail, is calculated according to the correlation according to FIG. 6. The mean value $\Delta u_r$ is formed over a base length (of approx. 5 to 10 m) from the residual superelevation error $\Delta u_r$ measured by the acceptance pendulum, and is added thereto. Said corrective value is now added to the predetermined superelevation value $\Delta u_w$ and is output as the new target superelevation value $\Delta u_w'$ to the control unit.

A wireless data transmission system having reference numeral 53 and comprising an antenna 54 is connected to the combined computer, which allows the direct transmission of the data. Reference numeral 49 is a GPS receiver with antenna 56, which adds absolute coordinates to the typical arc length data of the track geometry. Reference numeral 50 is a wireless LAN device with antenna 51 which allows the data transmission from an image recording device 52, i.e. a camera or the like.

FIG. 8 schematically shows a screen 39 for the control and master computer of the tamping machine according to the prior art. Reference numeral 38 shows the kilometer mileage. The column 34 shows the progression of the target lining value. Column 35 shows the progression of the target longitudinal altitude value. Column 36 shows the progression of the target elevation and column 37 shows the progression of the lining corrective value.

FIG. 9 schematically shows the screen 40 of the acceptance recording according to the prior art. As is shown in the image, said screen shows with the usual configurations the twisted X/Y axes on a separate monitor in comparison to the screen display of the illustration on the control and master computer. Reference numeral 38 shows the kilometer mileage. The column 34 shows the progression of the direction after processing. Column 35 shows the progression of the longitudinal altitude after the processing. Column 36 shows the progression of the achieved superelevation, and column 37 shows the progression of the remaining lining error.

FIG. 10 shows the combined data display in accordance with the invention with the same X/Y axial lining in one image. The screen can continuously be divided via a slider 47 into a control and master computer record 39 and an acceptance record 40. The columns correspond to the columns as described in FIGS. 8 and 9. In the acceptance record, tolerances (43, 44, 45, 46) have been entered for the individual acceptance quantities. In order to show the machine operator the effectiveness of the invention (and to provide a possibility for intervention), the target superelevation record (column 36) of the control and master computer display shows the superelevation correction (dashed line) $\Delta u_c+\Delta u_r$. Similarly and in contrast thereto, the remaining residual error $\Delta u_r$ can be designated in the acceptance record. In the column 37 for the corrective lining value, progression of the corrective overpressing value $\Delta c_w+\Delta c_r$ is shown in the control and master computer record. In contrast, the acceptance record of column 37 shows the residual lining error $\Delta c_r$. Symbol 53 designates a point in the track in which a particularity of the track was documented by the image recording device. In the case of GPS coordinates, they will be added in addition to the arc length data in column 38. Reference numeral 55 shows a position in which it was not possible to prevent the exceeding of the tolerance.

The invention claimed is:

1. A track adjustment system for operation of a permanent-way machine which is displaceable on a track system, said track adjustment system comprising:

computer-controlled lifting and lining devices adjusting a track position of a track of the track system, a control measuring system measuring the track position in a region of the lifting and lining devices, an acceptance measuring system measuring a corrected track position, and a tamping unit tamping a ballasted track of the track system, wherein the amount of elastic springback ($\Delta c_w$) of a track panel caused by a lining force acting on the track is calculated and said elastic springback ($\Delta c_w$) is considered in a target value lining specification in such a way that the lifting and lining devices displace the track by an amount of elastic springback ($\Delta c_w$) beyond a target position.

2. A track adjustment system according to claim 1, wherein a mean lining error ($\Delta c_r$) is calculated from a difference between the target position and an acceptance measurement by the acceptance measuring system, by which the track is additionally displaced by the lifting and lining devices within the terms of an approach to the target position.

3. A track adjustment system according to claim 1, wherein a resulting subsidence ($\Delta u_r$) of a superelevation ($\Delta u_c$) of the track system is calculated and is considered in a target value superelevation specification ($\Delta u_w'$) in such a way that the lifting and lining devices lift the track by an amount of the calculated subsidence ($\Delta u_c$) over the target position.

4. A track adjustment system according to claim 3, wherein a mean superelevation error ($\Delta u_r$) is calculated from a difference between the target position and the acceptance measurement of the acceptance measuring system, by which the track is additionally displaced by the lifting and lining devices within the terms of an approach to the target position.

5. A track adjustment system according to claim 3, wherein the subsidence ($\Delta u_r$) of the superelevation ($\Delta u_c$) of the track system of a track is calculated from an altitude position of the superelevated set of tracks ($\Delta u_w$).

6. A track adjustment system according to claim 1, wherein the lining force is measured using force sensors and/or pressure sensors ($p_R$, $p_K$) assigned to the lifting and lining devices, and elastic springback ($\Delta r_w$) of the track is calculated from said measured values.

7. A track adjustment system according to claim 1, wherein a common output device is assigned to the control measuring system and the acceptance measuring system, with which results of the measurements are displayed.

8. A track adjustment system according to claim 7, wherein corrective values are displayed by the common output device.

9. A track adjustment system according to claim 7, wherein the common output device is a monitor or a data logger.

10. A track adjustment system according to claim 1, wherein the control measuring system and the acceptance measuring system are assigned to a common computer device.

11. A track adjustment system according to claim 1, wherein positional data determined using a GPS device are assigned to the measured values of the control measuring system and the acceptance measuring system.

12. A track adjustment system according to claim 1, wherein the measured values of the control measuring system, the acceptance measuring system and/or corrective values are transmitted via a radio transmission link to a computer system.

13. A track adjustment system according to claim 1, wherein the track system is monitored using at least one image recording device, and the data of the at least one image recording device are transmitted via a radio link to a computer device, where measured values, corrective values and optionally positional data are assigned to the image data.

14. A track adjustment system according to claim 13, wherein the radio link is a wireless LAN.

* * * * *